US006016833A

United States Patent [19]

Spurny et al.

[11] Patent Number: 6,016,833

[45] Date of Patent: Jan. 25, 2000

[54] VALVE PLATE FOR PISTON COMPRESSOR, ESPECIALLY FOR AIR COMPRESSION IN MOTOR VEHICLES

[75] Inventors: Dieter Spurny, Reichertshausen; Jakob Theiss, Münchne, both of Germany

[73] Assignee: Knorr-Bremse Systems Fur Nutzfahrzeuge GmbH, Munich, Germany

[21] Appl. No.: 09/011,558

[22] PCT Filed: Aug. 7, 1996

[86] PCT No.: PCT/DE96/01476

§ 371 Date: Feb. 10, 1998

§ 102(e) Date: Feb. 10, 1998

[87] PCT Pub. No.: WO97/07336

PCT Pub. Date: Feb. 27, 1997

[30] Foreign Application Priority Data

| | | | |
|---|---|---|---|
| Aug. 6, 1995 | [DE] | Germany | 195 31 415 |
| Aug. 11, 1995 | [DE] | Germany | 195 29 685 |

[51] Int. Cl.[7] ..... F16K 15/00; F16K 49/00

[52] U.S. Cl. ..... 137/512.1; 137/340; 417/571

[58] Field of Search ..... 137/340, 512.1, 137/512; 417/571; 230/231

[56] References Cited

U.S. PATENT DOCUMENTS

| | | | |
|---|---|---|---|
| 1,287,530 | 12/1918 | Voss | 137/512.1 |
| 1,768,844 | 7/1930 | Holdsworth | 137/512.1 |
| 2,036,799 | 4/1936 | Duryee | 230/231 |
| 2,043,849 | 6/1936 | Bixler . | |
| 2,151,746 | 3/1939 | Cody . | |
| 2,449,408 | 9/1948 | Naab | 137/512.1 |
| 2,852,184 | 9/1958 | Stolte . | |
| 2,935,248 | 5/1960 | Gerteis | 230/231 |
| 3,795,778 | 3/1974 | Rees | 200/19 R |
| 3,986,798 | 10/1976 | Lindell et al. . | |
| 4,153,394 | 5/1979 | Nakada | 417/571 |
| 4,283,166 | 8/1981 | Hiraga | 417/269 |
| 4,886,424 | 12/1989 | Ikeda et al. | 137/512.15 |
| 5,222,516 | 6/1993 | Schrocker | 137/512.1 |
| 5,266,016 | 11/1993 | Kandpal . | |
| 5,454,397 | 10/1995 | Miszczak . | |
| 5,558,508 | 9/1996 | Sesano et al. . | |
| 5,603,611 | 2/1997 | Tarutani et al. . | |

FOREIGN PATENT DOCUMENTS

| | | |
|---|---|---|
| 372 154 B1 | 6/1990 | European Pat. Off. . |
| 571 715 A1 | 12/1993 | European Pat. Off. . |
| 705 977 A1 | 6/1996 | European Pat. Off. . |
| 1 129 784 | 5/1962 | Germany . |
| 3305791 A1 | 8/1984 | Germany . |
| 3813539C2 | 11/1986 | Germany . |
| 3909531A1 | 6/1990 | Germany . |
| 992232 | 3/1962 | United Kingdom . |
| 1132506 | 10/1966 | United Kingdom . |
| 1409589 | 10/1975 | United Kingdom . |
| 2018364 | 10/1979 | United Kingdom . |
| 2044365 | 10/1980 | United Kingdom . |
| 2 165 317 | 4/1986 | United Kingdom . |
| 2208 180 | 3/1989 | United Kingdom . |

OTHER PUBLICATIONS

Tambour moteur hydraulique, page from Pour plus de details, carclez le n° 13, sur les cartes documentation–publicité.

*Primary Examiner*—Denise L. Ferensic
*Assistant Examiner*—Joanne Y. Kim
*Attorney, Agent, or Firm*—Barnes & Thornburg

[57] ABSTRACT

A valve plate for a piston compressor, in particular for air compression in motor vehicles, consists of two mutually facing and connected plate halves, each of which is made of a diecast material such that the valve plate consists of two diecast plates. The two diecast plates are joined together by coating or gluing, the sealant in the sealing gap between the two diecast plates being protected against thermal effects in the region of the pressure apertures by protective bodies (sleeves, steel rivets) that can be inserted in the pressure apertures.

11 Claims, 3 Drawing Sheets

VALVE PLATE FOR PISTON COMPRESSOR, ESPECIALLY FOR AIR COMPRESSION IN MOTOR VEHICLES

BACKGROUND AND SUMMARY OF THE INVENTION

The invention relates to a valve plate for a piston compressor and more specifically for an air compressor in motor vehicles.

Valve plates for piston compressors which are provided especially but not exclusively for the air compression in motor vehicles, according to a known construction, consist of two individual plates of which one is generally constructed as a steel plate and the other is constructed as a diecast plate containing coolant flow ducts. The JP-A-59 208 181 discloses a valve plate for a compressor which consists of two mutually connected plate halves. In the case of this plate, the lines which are part of the valve elements are formed after the connecting of the two plate halves.

Based on the above, it is an object of the invention to simplify, with respect to their manufacturing, valve plates or valve supports consisting of plate halves. The possibilities of a sufficient cooling by a cooling duct situated in the valve plate, the shielding of the pressure bores or pressure apertures against thermal effects and the design of the valve seats for the pressure bores are to be optimized.

This object is achieved by further developing the valve plate to consist of two individual plates which are each made of a diecast material. The manufacturing possibilities are optimized because, with the exception of the sealing surface machining, all mechanical machining can be eliminated. The divided construction, which consists of diecast plates, also permits the most complicated cooling water guiding, particularly to guide cooling water directly to the hottest point, specifically the pressure bores or pressure apertures. A high-strength connection of both diecast plates is ensured by gluing while the sealing is sufficient. For optimizing the sealing tightness in the area of the pressure apertures, sleeves can be inserted in the apertures. Instead of the sleeves, steel rivets may also be provided which, as tubular rivets, are advantageously provided for the mutual bracing of the valve plate halves as well as for shielding the glued-together intermediate area of the two valve plate halves with respect to thermal effects. Because of the diecast construction, it is also possible to provide grooves for elastomer seals on the pressure side as well as on the suction side. The elastomer seals have a sealing effect with respect to the cylinder and the cylinder head. Elastomer seals in grooves may also be provided between the two plates.

Advantageous developments and further developments are indicated in additional claims.

BRIEF DESCRIPTION OF THE DRAWINGS

In the following, the invention will be explained by means of an embodiment with reference to the attached drawing.

DETAILED DESCRIPTION OF THE PREFERRED EMBODIMENTS

Figure 1:
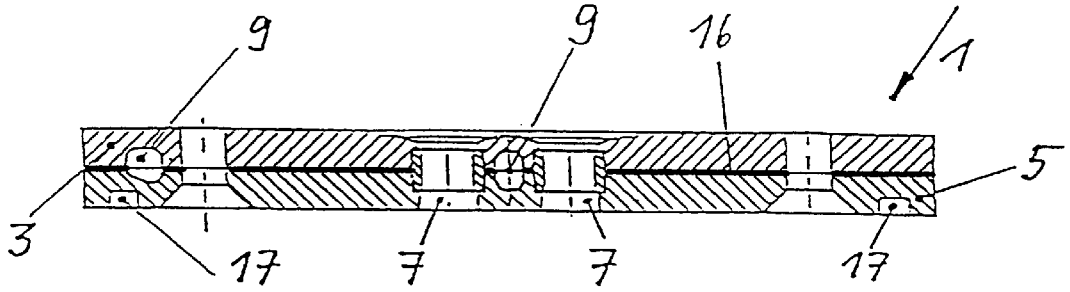
FIG. 1 is a sectional view of a valve plate according to the invention extending through two pressure apertures.

The valve plate 1 according to the invention illustrated in FIG. 1 of the drawing consists of a diecast plate 3 and a diecast plate 5. The diecast plate 3 faces the pressure side of the piston compressor, while the diecast plate 5 is provided on the suction side. The diecast plates 3 and 5 each consist of a high-strength aluminum alloy, in which case a particularly high capacity for resistance is achieved because of the existing skin. Furthermore, because of the diecast constructions of both plate halves, all mechanical machining can be eliminated with the exception of the sealing surface machining (both surfaces).

Figure 2:
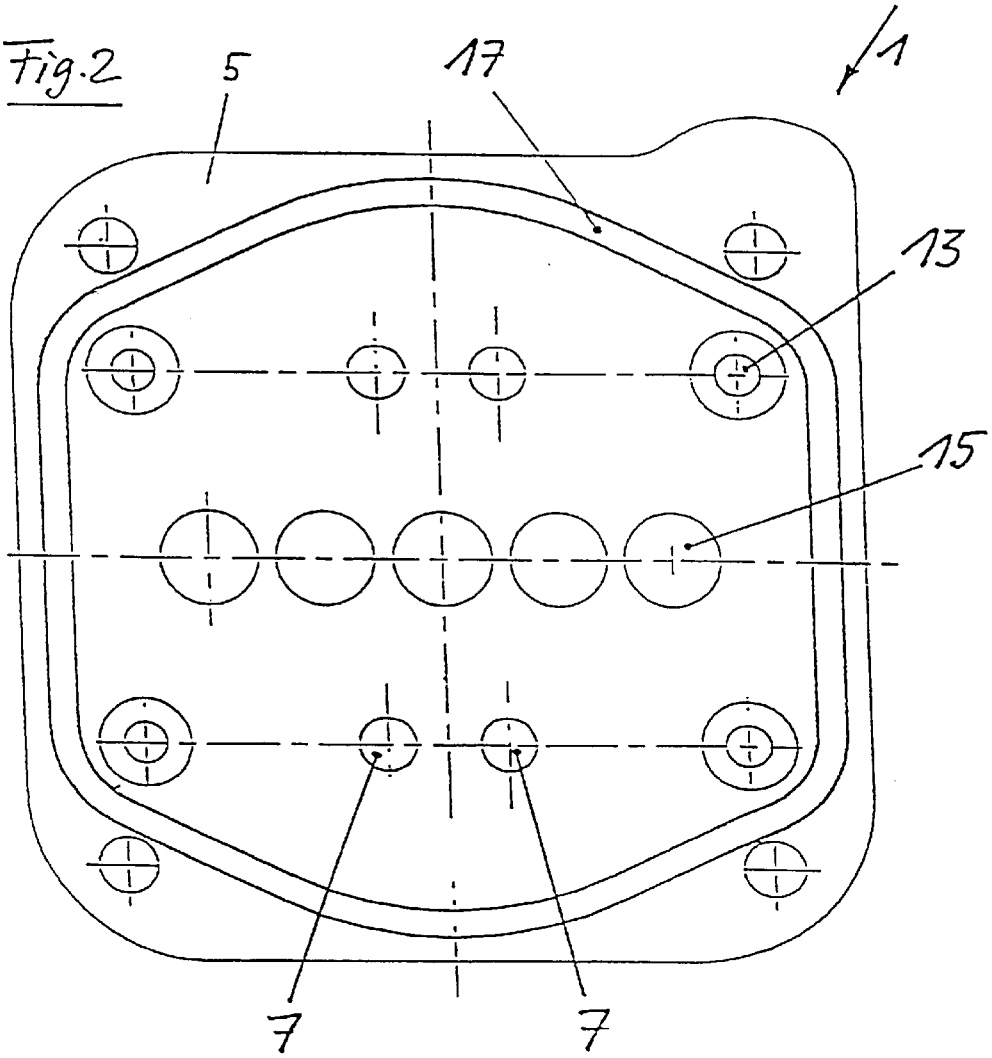
FIG. 2 is a top view of the suction side of the valve plate illustrated in FIG. 1.

As a sectional view of the valve plate, which extends in the area of two pressure bores or pressure apertures 7, FIG. 1 discloses that a coolant duct 9 extends in the valve plate. The coolant duct 9 is preferably situated in the area of the pressure apertures 7 and has (not shown) inflow and outflow openings for the coolant. The coolant duct 9 is formed by indentations in the mutually facing plates halves. On the pressure side, one pressure disk respectively (not shown) is assigned to the pressure apertures 7 illustrated as a sectional view in FIG. 1 and as a top view in FIG. 2. This pressure disk moves with respect to the valve seats 11 illustrated in FIG. 3 as an enlarged sectional view and is, in each case, held in the area of bores 13 by (not shown) fastening elements. A suction disk (not shown) is assigned to the suction apertures 15 illustrated as a top view in FIG. 2. This suction disk is held in a manner not explained in detail on the suction side of the valve plate and acts with respect to the suction apertures 15. Basically, the invention is not limited to the special embodiment of a valve or disk construction for the pressure side and the suction side, although valve disks with a simultaneously covering of several apertures are preferably usable for the pressure side as well as the suction side.

The two diecast plates 3 and 5 can be connected and sealed by a coating or gluing in the area of the sealing surface 16. A metal seal between the diecast plates coated on both sides can be provided. Because of the diecast construction of the two diecast plates 3 and 5, it is possible in a simple manner to provide one groove 17 respectively for an elastomer seal on the suction side and/or the pressure side. In the case of the embodiment illustrated in FIGS. 1 and 2, the groove 17 is provided on the suction side, that is, on the side of the diecast plate 5 facing the cylinder. Such a groove with an elastomer seal may also be provided on the pressure side, that is, on the top side of the diecast plate 3. It is also possible to additionally provide a groove with an elastomer seal between the two diecast plates at sealing surface 16.

Figure 3:
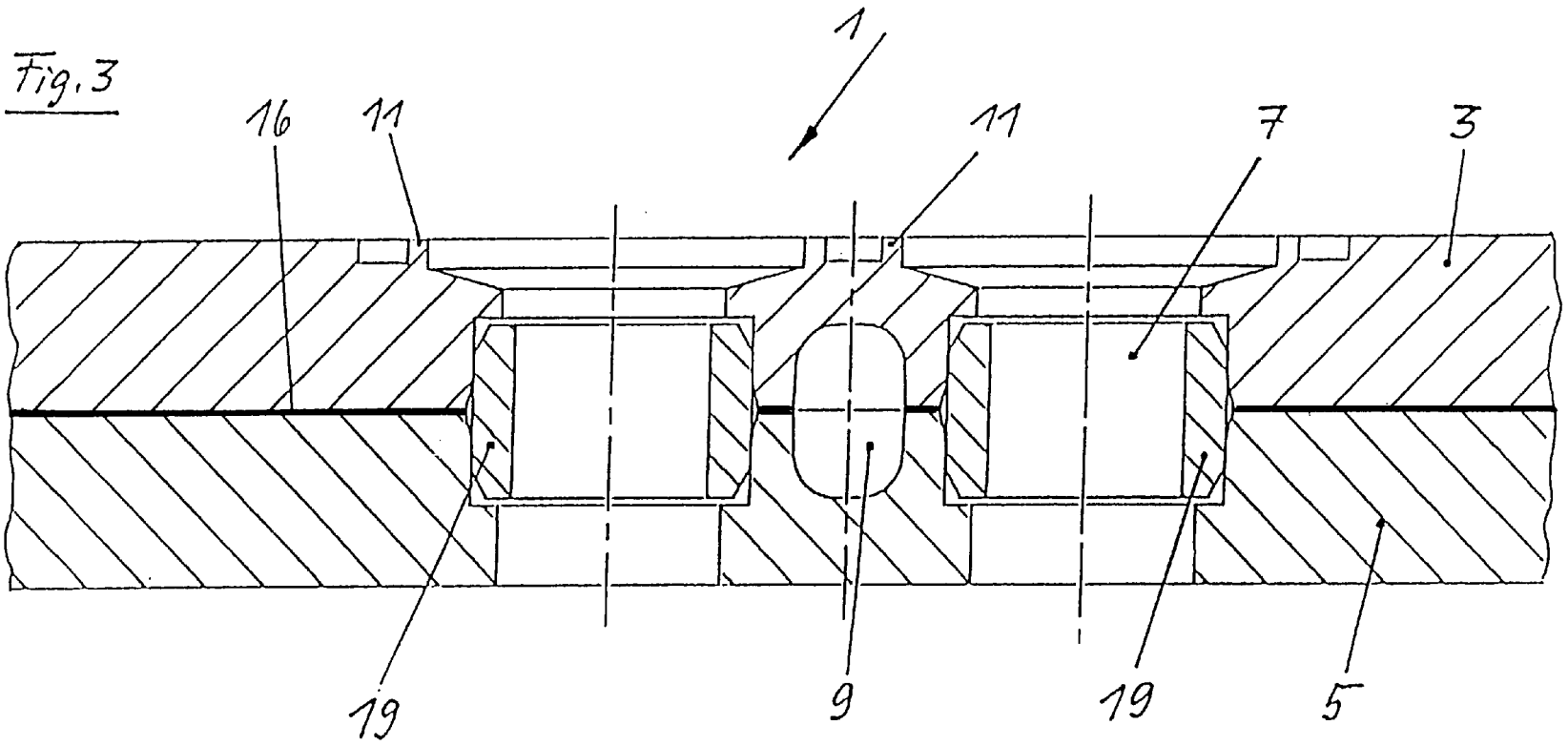
FIG. 3 is an enlarged partial sectional view of the valve plate according to FIG. 1.

In the enlarged partial sectional view according to FIG. 3, sleeves 19 are illustrated as insertion parts in the pressure apertures 7 of the valve plate 1. The sleeves 19 are received in indentations in the mutually facing plate halves along the apertures. By means of these sleeves, the hot compressed air is separated from the used sealants or glues which are used for joining the two diecast plates 3 and 5. In addition, the connection of the two diecast plates receives a certain amount of stability. The use of such sleeves 19 is particularly advantageous because the highest temperatures occur in the passage area in question of the pressure apertures 7, and in the case of conventionally divided valve plates, there was the danger of a thermal destruction of the sealants.

The inflow and outflow edges of the apertures or bores penetrating the valve plate, thus of the pressure apertures and of the suction apertures, because of a rounding or profiling, are designed such that flow losses are reduced to a minimum.

Figure 5:
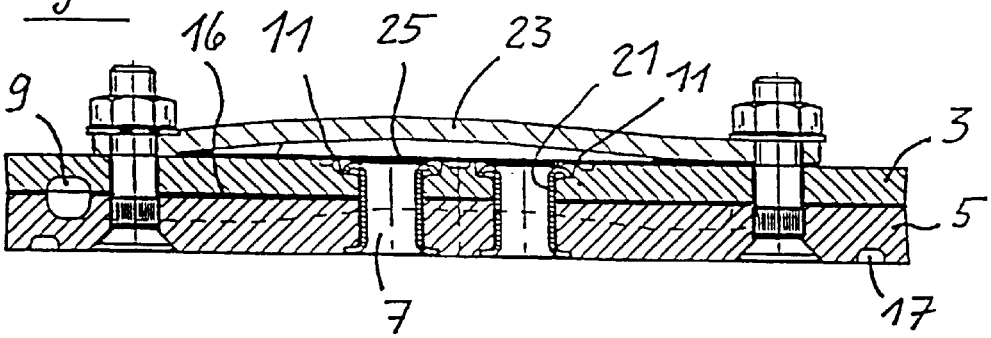
FIG. 5 is a sectional view of Line V—V in FIG. 4 illustrating the valve plate with steel rivets penetrating the pressure apertures.
Figure 4:
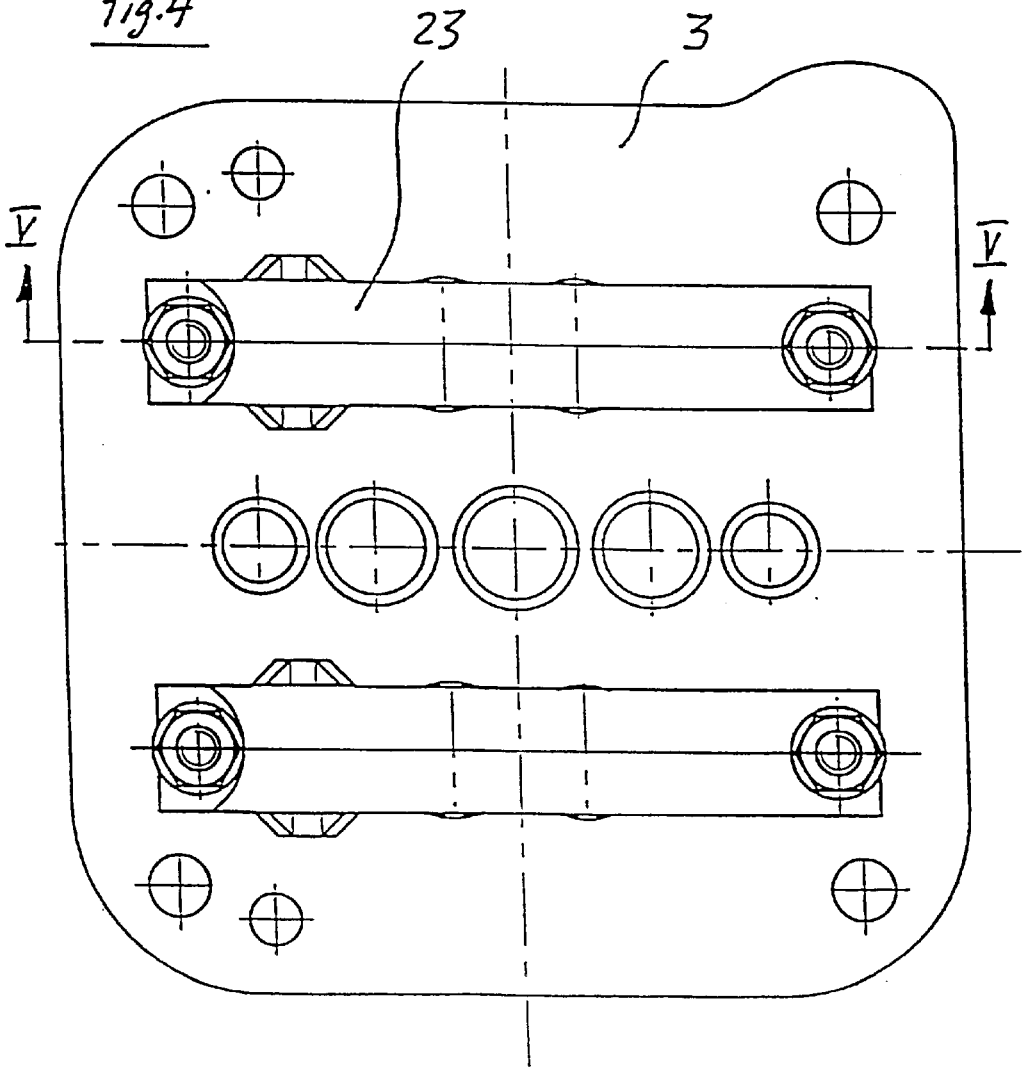
FIG. 4 is a top view of a valve plate according to another embodiment of the invention illustrating two valve catches.

FIGS. 4 and 5 illustrate a valve plate according to another embodiment of to the invention. The valve plate correspondingly consists of two diecast plates 3 and 5 which are provided with pressure bores or pressure apertures 7. Instead of the sleeve 19 of the arrangement according to FIG. 3, steel rivets 21 are inserted into the pressure apertures 7 and are braced with respect to the plate halves by means of the riveting operation. The steel rivets therefore not only have the function of shielding the separation area between the plate halves with respect to the thermal effect of the generated compressed air, but also provide a holding and bracing function with respect to the two plate halves. This is particularly advantageous in the area of the pressure apertures because of the considerable temperature differences. According to the illustration, the steel rivets are constructed as tubular rivets which carry the rivet head or end flange situated at the lower end in FIG. 5 and whose opposite end is shaped as an end flange in a known manner in the riveting operation. The end flanges lie in the profiles or rounded portion of the apertures. In the embodiment according to FIGS. 4 and 5, two valve catches or stops 23 are illustrated which, in a known manner, are used for catching or stopping the also shown valve disk(s) 25 covering the pressure apertures 7.

Although the present invention has been described and illustrated in detail, it is to be clearly understood that the same is by way of illustration and example only, and is not to be taken by way of limitation. The spirit and scope of the present invention are to be limited only by the terms of the appended claims.

List of reference numbers valve plate
diecast plate
diecast plate
pressure aperture
coolant duct
valve seat
bore
suction aperture
sealing surface
groove
sleeve
steel rivet
valve catch
valve disk

We claim:

1. A valve plate for a piston compressor including two mutually connected plate halves carrying pressure and suction valve elements, and wherein a) the two plate halves of the valve plate are diecast plates with a seal therebetween, b) on a pressure side of the valve plate, at least one pressure aperture is surrounded by a valve seat for the pressure valve element, which valve seat is part of the diecast plate, and c) a protection body is inserted into the at least one pressure aperture which protects a gap area of the seal between the two diecast plates with respect to a thermal effect.

2. A valve plate according to claim 1, wherein the protection body consists of a sleeve.

3. A valve plate according to claim 2, wherein the sleeve is an indentation in the mutually facing plate halves along the apertures.

4. A valve plate according to claim 1, wherein the protection body consists of a steel rivet.

5. A valve plate according to claim 1 including several pressure apertures containing one protection body respectively.

6. A valve plate according to claim 1 including at least one groove for an elastomer seal is provided in the suction and/or pressure side of the valve plate.

7. A valve plate according to claim 1 wherein inflow and outflow edges of the pressure and suction apertures are profiled or rounded for the purpose of minimizing the flow losses.

8. A valve plate according to claim 7 wherein the protection body consists of a rivet having end flanges in the profiled or rounded portions of the apertures.

9. A valve plate according to claim 1, wherein the pressure valve element consists of a valve disk which is caught with respect to a valve catch.

10. A valve plate for a piston compressor including two mutually connected plate halves carrying pressure and suction valve elements, and wherein the two plate halves of the valve plate are diecast plates with a seal therebetween, on a pressure side of the valve plate, at least one pressure aperture is surrounded by a valve seat for the pressure valve element, which valve seat consists of the material of the diecast plate, a protection body is inserted into the at least one pressure aperture which protects a gap area of the seal between the two diecast plates with respect to a thermal effect, and wherein a coolant duct is provided in the valve plate and has duct walls formed by indentations in the mutually facing plate halves.

11. The valve plate of claim 10 wherein the valve seat is part of the diecast plate.

* * * * *